US006076321A

United States Patent [19]

Holland

[11] Patent Number: 6,076,321

[45] Date of Patent: Jun. 20, 2000

[54] FLAT-MOUNT LOUVER ASSEMBLY

[76] Inventor: Ronnie W. Holland, 100 Hickory La., Edenton, N.C. 27932

[21] Appl. No.: 08/990,321

[22] Filed: Dec. 11, 1997

[51] Int. Cl.[7] ..... E06B 7/08

[52] U.S. Cl. ..... 52/473; 52/198; 52/199

[58] Field of Search ..... 52/198, 199, 473, 52/656.7, 656.8, 656.9

[56] References Cited

U.S. PATENT DOCUMENTS

| | | | |
|---|---|---|---|
| 3,120,036 | 2/1964 | Minds, Jr. | 52/473 X |
| 3,394,518 | 7/1968 | Worrell, Jr. | 52/473 |
| 3,638,383 | 2/1972 | Ribas | 52/473 |
| 3,943,679 | 3/1976 | Dissinger . | |
| 3,968,738 | 7/1976 | Matzke . | |
| 4,831,804 | 5/1989 | Sayer | 52/656.9 X |
| 4,875,317 | 10/1989 | Logan et al. . | |
| 4,875,318 | 10/1989 | MacLeod et al. | 52/211 |
| 4,939,880 | 7/1990 | Wang | 52/473 |
| 5,524,407 | 6/1996 | Ricard et al. | 52/473 |
| 5,596,852 | 1/1997 | Schiedegger | 52/212 |
| 5,651,222 | 7/1997 | Bridges et al. . | |
| 5,673,526 | 10/1997 | Schiedegger et al. | 52/473 |

FOREIGN PATENT DOCUMENTS

| | | | |
|---|---|---|---|
| 2029117 | 10/1970 | France | 52/473 |
| 2257771 | 8/1975 | France | 52/473 |
| 2263367 | 10/1975 | France | 52/473 |

*Primary Examiner*—Carl D. Friedman
*Assistant Examiner*—Timothy B. Kang
*Attorney, Agent, or Firm*—Griffin, Butler, Whisenhunt & Szipl, LLP

[57] ABSTRACT

A flat-mount louver assembly (9) includes a plurality of slats (10) mounted in a louver jamb subassembly (40). The subassembly includes C-shaped jamb segments (20') joined together at a mitered joint (44) with their open faces facing one another and holding the slats between them. The louver jamb subassembly is mounted in a jamb slot (25) of a louver mounting band (15). The louver mounting band has a planar mounting base (75), a planar jamb wrap connector (52) perpendicular to the base and having a connecting-member edge spaced apart from the base, and a flange (53) substantially perpendicular to one side of the connecting member edge. The flange and jamb wrap connector, with a portion of the base, make up the jamb slot. The slats are preferably configured with raised edges to resist the flow of water.

9 Claims, 7 Drawing Sheets

FLAT-MOUNT LOUVER ASSEMBLY

FIELD OF THE INVENTION

The present invention relates to louver assemblies for use in the construction of buildings.

DESCRIPTION OF THE PRIOR ART

Louver assemblies are commonly placed in walls of gable areas of buildings to provide for passive ventilation of the building interiors. Virtually identical louver assemblies may be used in areas other than gables to achieve the same effect.

U.S. Pat. No. 3,120,036 to Minds describes a louver assembly comprising a jamb that has securing flanges 18 and 19 for securing the jamb to a vent opening frame structure. U.S. Pat. No. 3,943,679 to Dissinger describes a louver assembly that includes mating frame sections 22 and 24. U.S. Pat. No. 3,968,738 to Matzke describes a louver assembly that comprises two flanges 13 for fitting over a stud or other portion of a wall which supports a louver. Each of the above patents is concerned with louver assemblies that are mounted in a wall of a building.

U.S. Pat. No. 4,875,317 to Logan et al provides a vacuum-formed window or vent insert, wherein a perimeter can be curved and formed with an undercut to receive adjacent edges of aluminum or plastic siding. U.S. Pat. No. 5,596,852 to Schiedegger provides a plastic building product that is designed to be adjustable so that it can accommodate siding of different thicknesses. Both of these patents describe louver assemblies that are mounted on walls of buildings.

The prior art does not describe a flat-mount louver assembly that can be easily made in a wide variety of configurations from a small number of simple components and still provide high quality features.

It is an object of this invention to provide a louver assembly that can be easily constructed in a variety of shapes from a small number of relatively-uncomplicated components.

It is also an object of the present invention to provide efficient louver slats that have a continuous perimeter on all four sides which allows for reversibility.

It is another object of the present invention to provide louver jambs that encase slats in order to contribute stability to a flat-mount louver assembly.

It is yet another object of the present invention to provide for a louver mounting band that can be cut into segments to encase a slat/jamb subassembly and that exhibits a variety of functional as well as aesthetic benefits in use.

These and other objects and advantages of the present invention will be made apparent from the following description when taken in conjunction with the accompanying drawings.

SUMMARY OF THE INVENTION

According to principles of this invention, a louver assembly is constructed of slats, jamb segments, and mounting-band segments. Slats, jambs, and mounting bands are manufactured in lengths of 8 or 16 feet, and these are cut into the segments for making a louver assembly. The jambs and mounting bands might, for instance, be cut to 2 foot segments, their ends being trimmed to an appropriate angle. Two jamb segments are brought together in a V-shape. The slats might be cut in a series of lengths, ranging from 3 inches to 16 feet, and their ends would be trimmed to an angle determined by the side of the V. The series of trimmed slats are arranged in the V-shaped jambs, with the shortest closest to the apex of the V, forming a louver jamb subassembly. This louver jamb subassembly is encased within the trimmed mounting-band segments, forming the louver assembly.

The present invention provides a flat-mount louver assembly comprising a plurality of slats having two ends and mounted in a louver jamb subassembly. This louver jamb subassembly comprises first and second C-shaped channels (jamb segments) joined together at a mitered joint with their open faces facing one another. The first channel holds one end of each of the slats and the second channel holds the other end of each of the slats. The louver jamb subassembly is mounted in jamb slots of louver mounting-band segments. The louver mounting band comprises first and second segments, each having a planar mounting base, a planar connecting member perpendicular to that base with a connecting-member edge spaced from the base, and a flange extending substantially perpendicular to one side of the connecting member at the connecting-member edge. The flange and connecting member, together with a portion of the base, define the jamb slot.

The slats used to make the louver assembly have raised edges to resist the flow of water. Also, the base of the louver mounting band, which forms the louver jamb receiving area, is wider than the flange so as to inhibit flow of water into a building fitted with the louver assembly.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
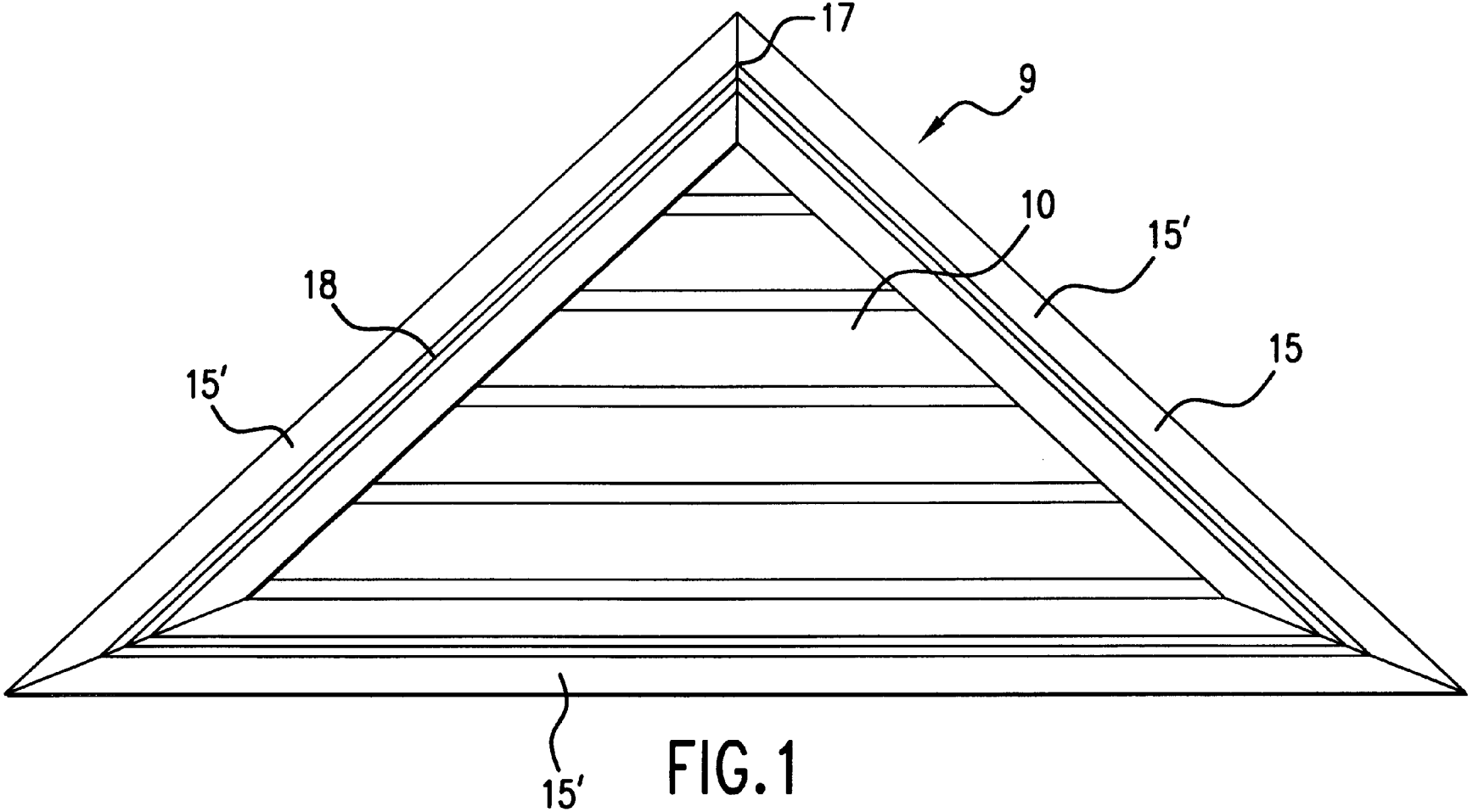
FIG. 1 is a front view of a gable louver assembly of this invention.

FIG. 1 shows a front view of a gable louver assembly 9 in accordance with the present invention. The gable louver assembly of FIG. 1 has a plurality of slats 10 that are held in a jamb (not visible in FIG. 1) to form a jamb subassembly which is, in turn, held in a jamb slot (not visible in FIG. 1) of mounting-band segment 15'. A miter-cut mounting band 15 has as its visible portion mounting-band tops 18 of the mounting-band segments 15' joined together at mitered joints 17.

Figure 2:
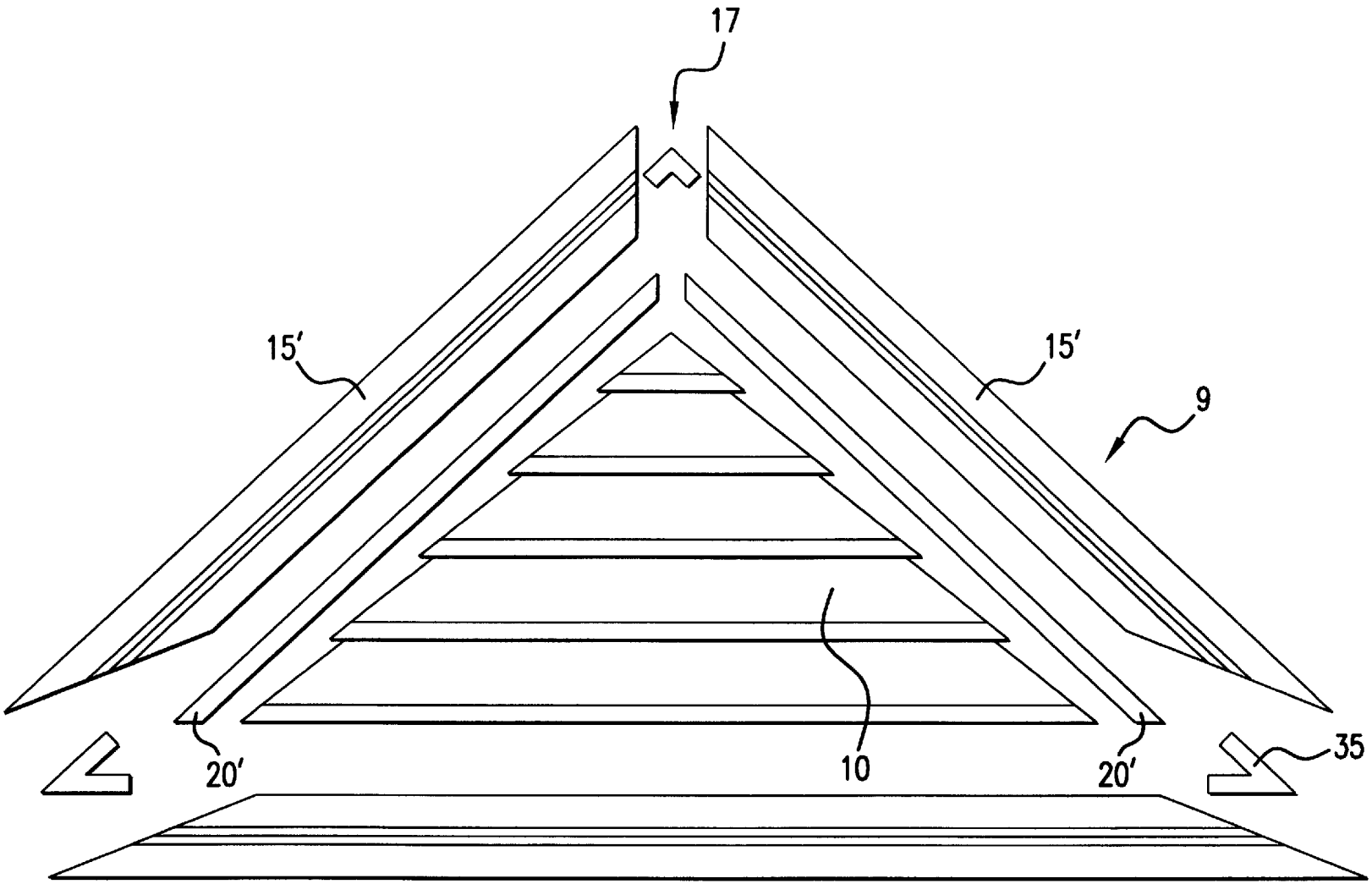
FIG. 2 is an exploded front view of the gable louver assembly of FIG. 1.
Figure 6:
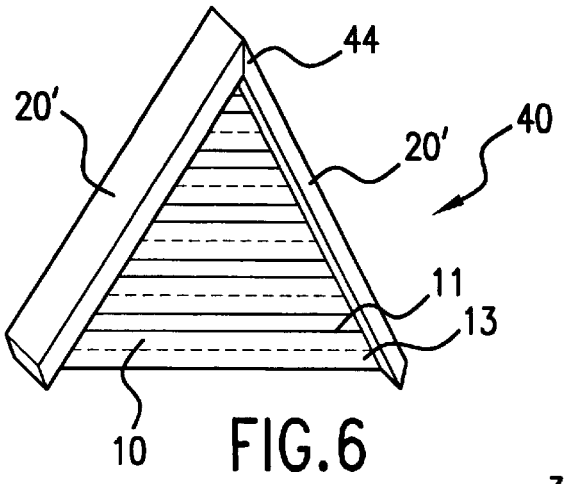
FIG. 6 is a perspective view of a louver jamb subassembly of the present invention with louvers mounted therein.

FIG. 2 shows in an exploded front view of the gable louver assembly 9 that the slats 10 are arranged in a pair of miter-cut jamb segments 20' (to form a louver jamb subassembly 40 shown in FIG. 6). The louver jamb subassembly 40 is held (by a jamb slot 25 shown in FIG. 7) within miter-cut mounting-band segments 15' joined together at mitered joints 17. The mitered joints 17 of the miter-cut mounting-band segments 15' are internally reinforced by miter stabilizer connectors 35 (held within miter stabilizer slots 38 shown in FIG. 7).

Slats

Figure 3:
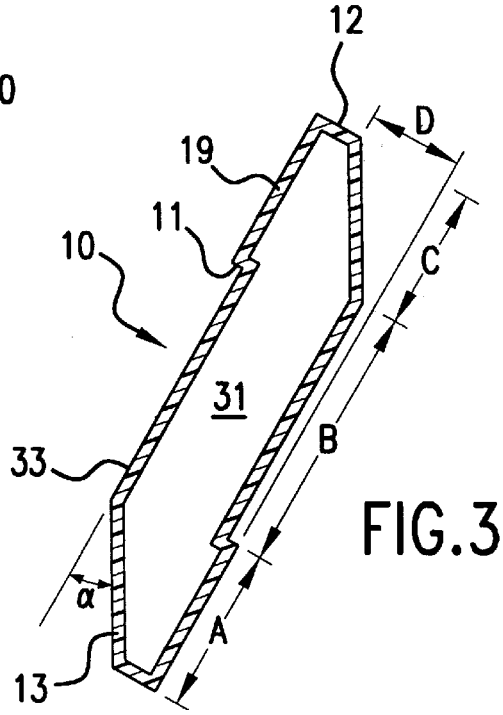
FIG. 3 is a cross-sectional view of a slat of the gable louver assembly of FIG. 1.

A slat 10 of a gable louver assembly (FIGS. 1 and 2) of the present invention is preferably configured with a 30° sloped side edge and a raised edge to divert rain from blowing into a building through a louver assembly of this invention. FIG. 3 shows a cross-section of a slat 10, having a raised edge 11 and a sloped side edge 13, where $\alpha$ is a 30° angle. As illustrated in FIG. 3, slats in accordance with the present invention are preferably configured to be reversible. However, a slat with only one raised edge (not shown) would perform equally well when its raised edge side is positioned to face outward from the building onto which it is installed.

Also as illustrated in FIG. 3, slats in accordance with the present invention are preferably made of a thin wall 19 of resinous material such as polyvinyl chloride, leaving an open inside space 31. This reduces weight and material cost. However, the hollow slats could be made of metal such as aluminum. Alternatively, the slats could be made of solid wood. An exterior polyvinyl chloride surface 33 can be textured to provide a wood grain effect. Slat 10 also has a flattened nose edge 12. These are preferred features that can contribute to a wood-like appearance in the slat.

In a preferred embodiment, a polyvinyl chloride slat wall thickness is 0.063 inches, a distance A from a nose edge to a raised edge is 0.875 inches, a height (or depth) of the raised edge is 0.063 inches, a distance B from the raised edge to a start of a sloped edge is 1.363 inches, and a distance C from the start of the sloped edge to a plane defined by the nose edge is 0.875, for an overall slat width of 3.000 inches, while a thickness of one nose edge is 0.249 inches and a thickness D from an end of a slope at that nose edge to a plane, defined by a flat surface which extends from the other nose edge of the slat to the raised edge, is 0.251, for an overall slat thickness of 0.725 inches. Those skilled in the art will recognize that slats with other dimensions can be made that will take full advantage of principles of the present invention.

Jambs

Figure 4:
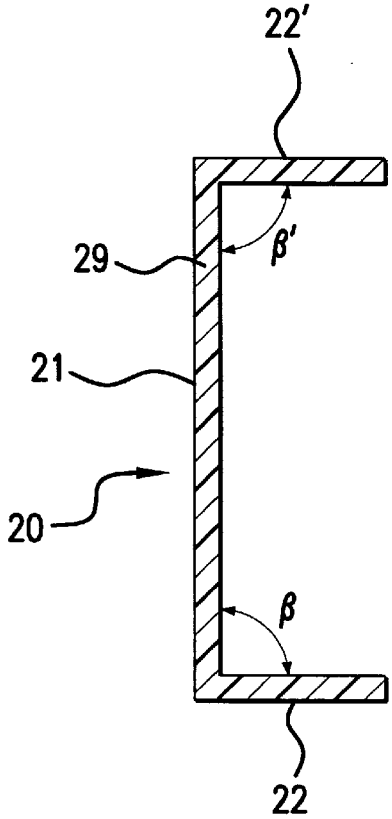
FIG. 4 is a cross-sectional view of a jamb of the present invention.

A jamb 20 (and jamb segments 20') of the louver jamb subassembly 40 of the present invention is made as a C-shaped member that is designed to encase the slats in order to hold them. FIG. 4 shows a cross-section of the jamb having a wall 29 of a resinous material such as polyvinyl chloride. Other materials could also be used, so long as they have an appropriate balance of rigidity and flexibility to provide a suitable anchor for the slats. The jamb 20 comprises a back 21 and two arms 22 and 22', extending outwardly at right angles $\beta$ and $\beta'$ from the back 21.

In a most preferred embodiment, a polyvinyl chloride jamb wall thickness is 0.063 inches, an outside width of the back is 1.438 inches, an outside width of each arm is 0.7 inches, and an inside width of the back is 1.312 inches. Those skilled in the art will recognize that dimensions of the jamb are related to dimensions of the slats and that jambs with other dimensions can be made that will take full advantage of principles of the present invention.

Louver Jamb Subassemblies

Figure 5:
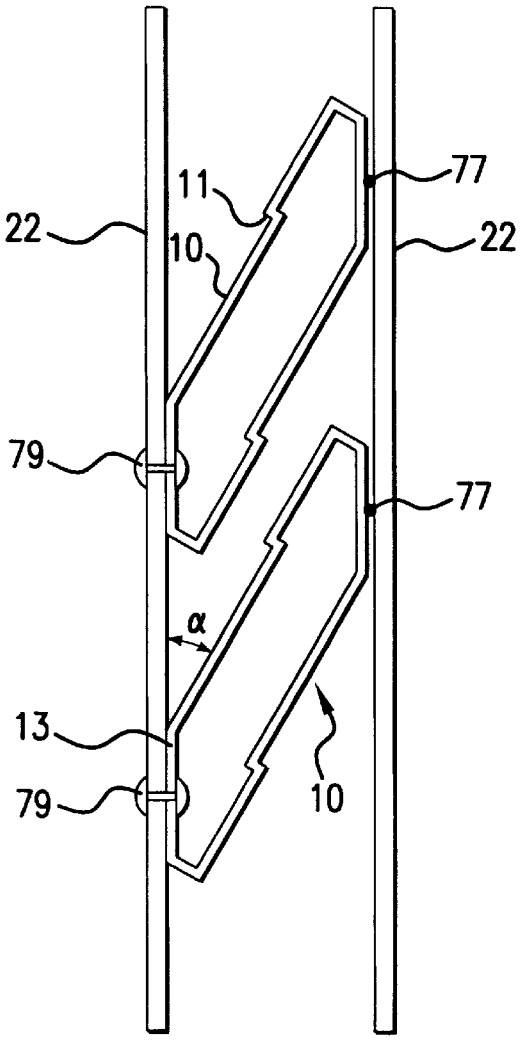
FIG. 5 is a cross-sectional view of portions of a jamb having slats inserted therein in accordance with the present invention.

FIG. 5 is a cross-sectional view of a jamb segment 20 (only the arms 22 and 22' being visible) having slats placed therein. In FIG. 5, jamb arms 22 and 22' hold between them the slats 10. Each slat is arranged so that each of its edges 13 contacts an opposite jamb arm. Each slat 10 is arranged at an angle $\partial$30° with respect to arms 22 and 22' at points at which the slat contacts the arms. The angle $\partial$ can range from about 15° to about 45°, and is preferably about 30°. The slats are arranged so that their raised edges 11 are higher than their sloped side edges 13.

FIG. 6 is a perspective view of a louver jamb subassembly 40. The louver jamb subassembly comprises slats 10 and miter cut jamb segments 20' attached together. In FIG. 6, two miter-cut jamb segments 20' have been joined together, open face to open face, with a plastic mending plate at a mitered joint 44, to form a V-shape. Several slats 10 of varying lengths have been inserted into the miter-cut jamb segments 20' to form the louver jamb subassembly 40.

Mounting Bands

Figure 7:
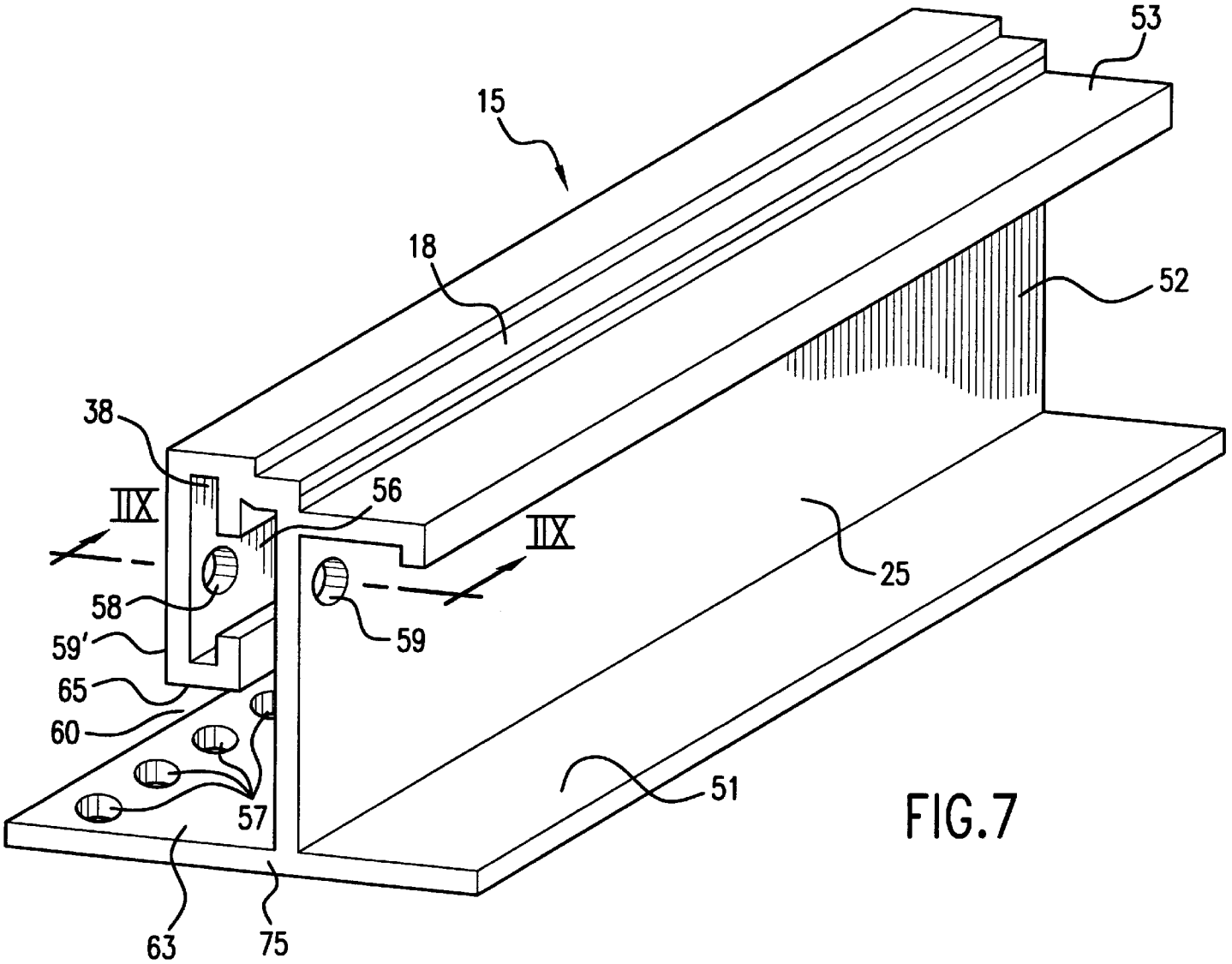
FIG. 7 is a perspective view of a mounting-band of the present invention.
Figure 8:
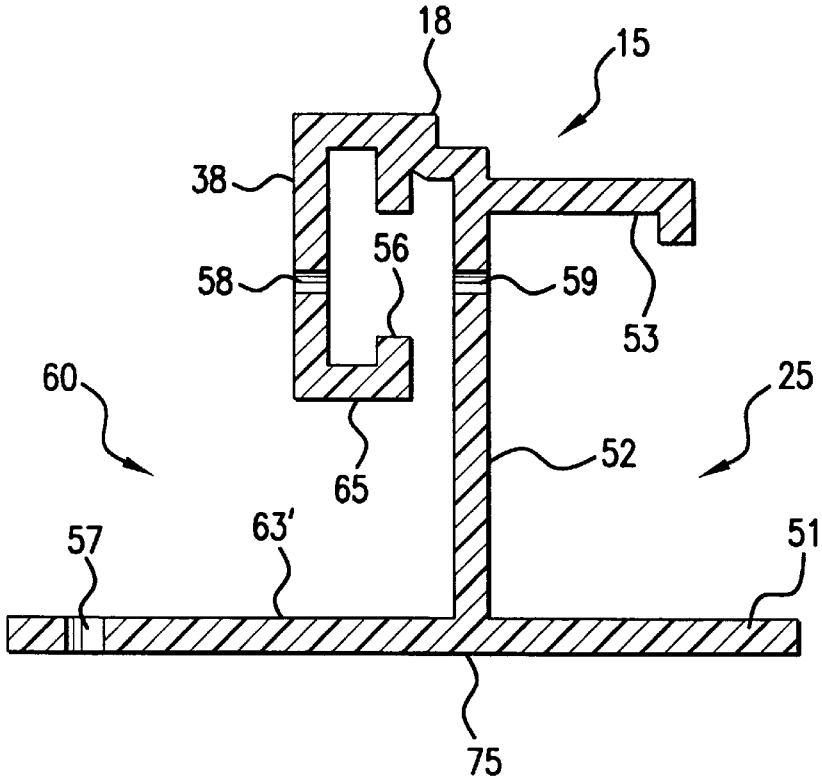
FIG. 8 is a sectional view taken on line IIX—IIX of the mounting band of FIG. 7.

The louver jamb subassembly 40 of the invention is preferably mounted in a mounting band 15 (FIGS. 7 and 8). The mounting band defines a jamb slot 25 for receiving the louver jamb subassembly 40. The jamb slot 25 is defined by a backing 51 (which is to be attached to a building), a jamb wrap connector 52, and a decorative flange 53 (which is visible when the louver assembly is mounted on a building). The backing 51, being wider than the decorative flange 53, acts to divert water away from an interior of the building, for a bottom-mounted mounting-band segment 15' incorporated into a gable louver assembly.

Another slot, siding slot 60, also defined by the mounting band 15 but on the opposite side of the jamb wrapper connector 52, is for receiving vinyl, aluminum, or wood siding. The siding slot 60 is defined by a backing 63 (which is a continuation of the backing 51), the jamb wrap connector 52, and a bottom 65 of a member forming the miter stabilizer slot 38. The miter stabilizer slot 38 is yet another slot defined by the mounting band 15. The mounting-band top 18 helps to form the miter stabilizer slot 38 and is preferably provided with a molded profile for aesthetics.

The backings 51 and 63 combine to form a mounting base 75.

The jamb wrap connector 52 is preferably pierced by one or more weep holes 59. Likewise, a member 59' forming the miter stabilizer slot 38 is preferably pierced by one or more weep holes 58. Advantageously, a weep hole of the jamb wrap connector 52 will be lined up with the miter stabilizer slot 38 to permit water to drip out of a bottom mounting-band segment of an installed gable louver assembly. The member 59' forming the miter stabilizer slot 38 is also preferably provided with a drain opening 56 along its entire length to allow water to escape. The backing 63 is preferably provided with a plurality of nail holes 57 to facilitate installation of the gable louver assembly on an outer wall of a building.

The mounting band 15 is preferably made from rigid polyvinyl chloride, although it could be made from other materials conventionally used to manufacture molding and related products.

In a most preferred embodiment, a wall thickness of all mounting-band elements, except for the mounting-band top 18, is 0.125 inches. The mounting-band top 18 will be of variable thickness as determined by its aesthetic molded profile. The backing 51 is 1.375 inches wide, the decorative flange 53 is 0.875 inches wide, and a distance from a bottom of the backing 51 to a top of the decorative flange 53 is 1.875 inches. In this most preferred embodiment, the backing 63 is 2.000 inches wide, a distance from the backing 63 to the miter stabilizer slot bottom member 65 is 1.000 inches, and the mounting-band top 18 is 0.875 inches wide. An outer wall of the member 59' forming the miter stabilizer slot 38 is 1.125 inches in length. The mounting base 75 is 3.250 inches in width. The width of the jamb slot 25 is 1.625 inches, which is larger than the outside width of the jambs.

Figure 9:
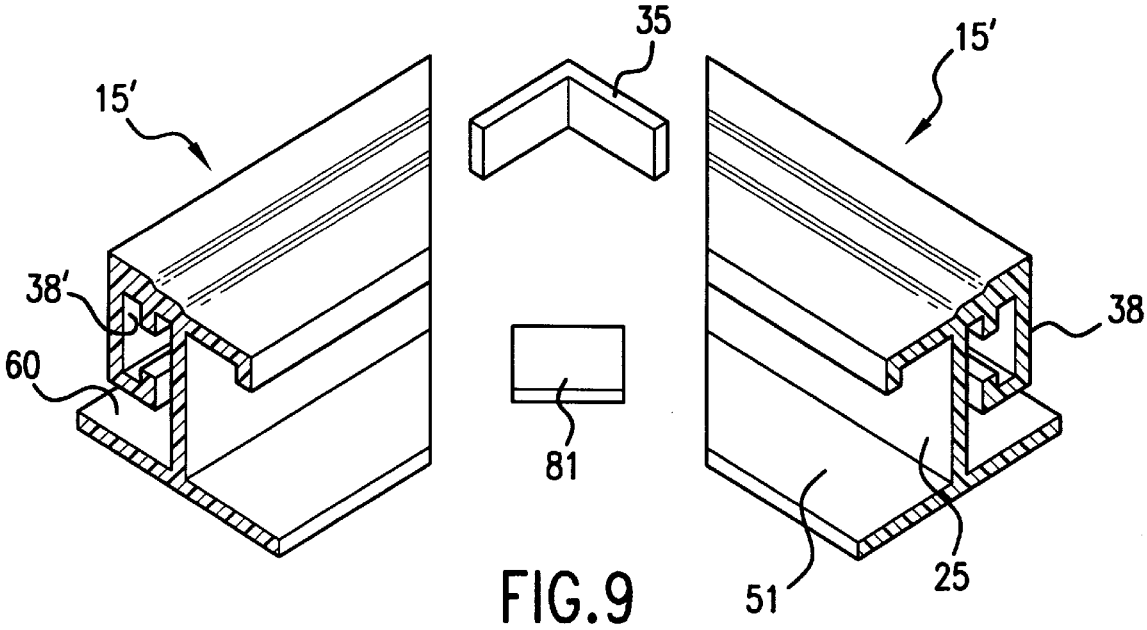
FIG. 9 is an exploded perspective cut away view of a mitered mounting band joint in accordance with the present invention.
Figure 10:
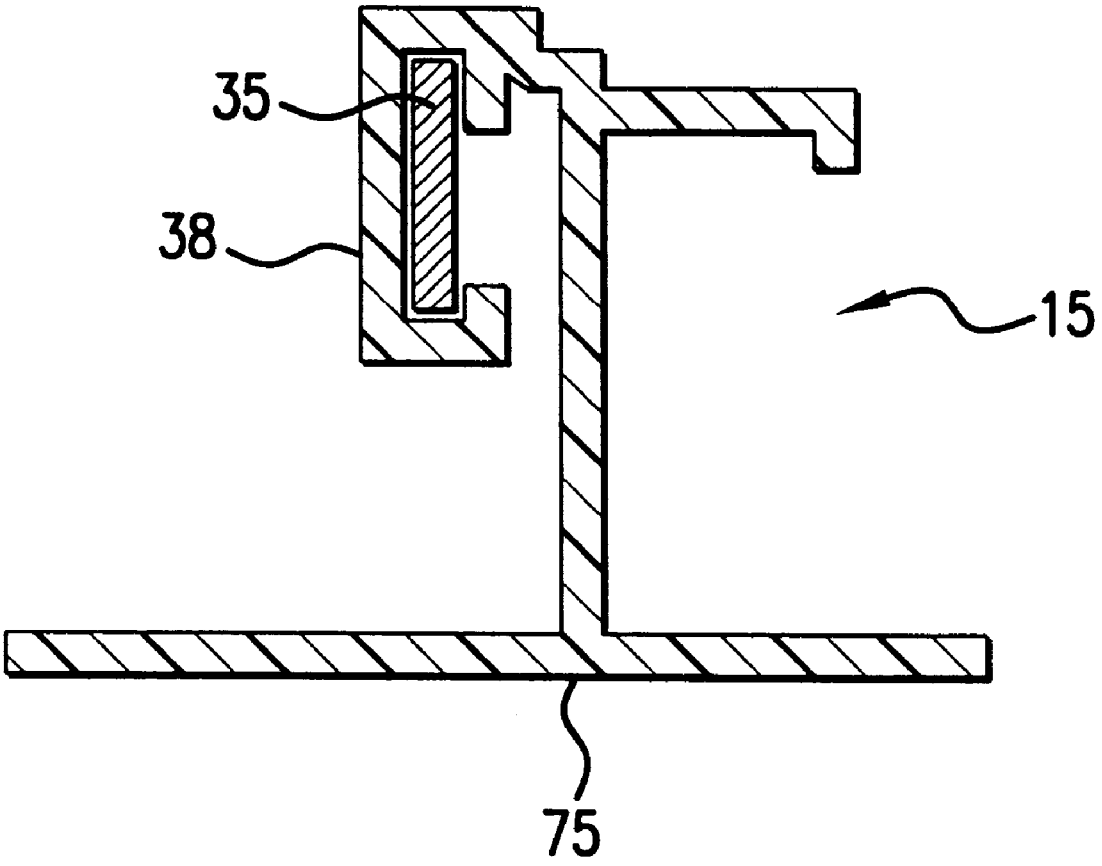
FIG. 10 is a cross-section taken near the mitered mounting-band joint of FIG. 9.
Figure 11A:
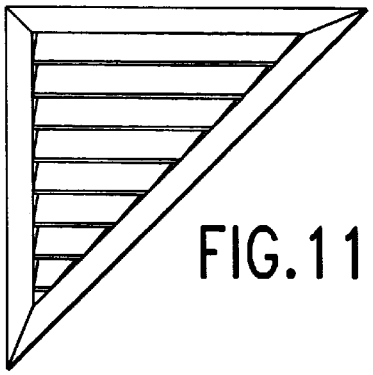
FIG. 11*a* is a front view of an alternate triangular configuration of a gable louver assembly of the invention.
Figure 11B:
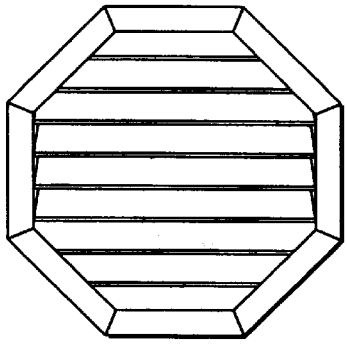
FIG. 11*b* is a front view of an octagonal configuration of a gable louver assembly of the invention.
Figure 11C:
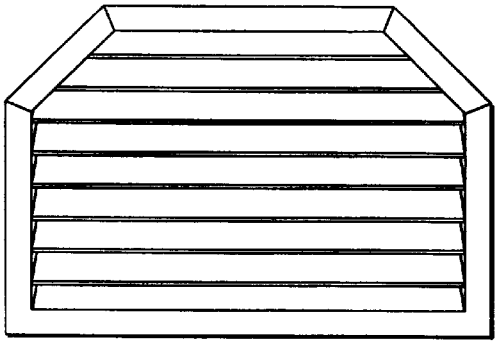
FIG. 11*c* is a front view of a hexagonal configuration of a gable louver assembly of the invention.
Figure 11D:
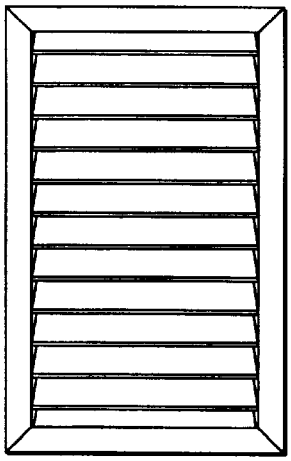
FIG. 11*d* is a front view of a rectangular configuration of a gable louver assembly of the invention.
Figure 11E:
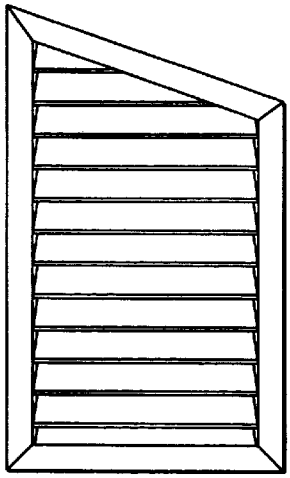
FIG. 11*e* is a front view of a quadrilateral configuration of a gable louver assembly of the invention.
Figure 11F:
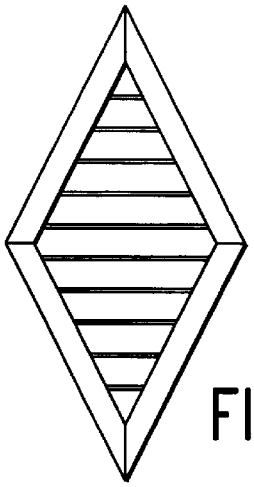
FIG. 11*f* is a front view of a diamond-shaped configuration of a gable louver assembly of the invention.

In use, a mounting band according to the present invention will be cut into segments in which the ends will be mitered, or angled. This is illustrated in FIG. 9, in which two segments of mounting band are shown, each having been cut to a complementary angle in a conventional manner, forming miter-cut mounting-band segments 15'. FIG. 9 also illustrates a miter stabilizer connector 35 in accordance with the present invention. The miter stabilizer connector 35 is designed to be inserted into the miter stabilizer slots 38 of both miter-cut mounting-band segments 15'. Accordingly, the miter stabilizer connector 35 will have an angle of opening that is double the miter angle of each mounting-band segment 15'. For instance, if each miter-cut mounting-band segment 15' has been cut back on an angle of 30°, miter stabilizer connector 35 will open 60°. The manner in which the miter stabilizer connector 35 acts to stabilize the miter joint when mounting-band segments in accordance with this invention are joined by a miter joint may be understood more fully by reference to FIG. 10. FIG. 10 shows a mounting band 15 having inserted within its miter stabilizer slot 38 a miter stabilizer connector 35. The miter stabilizer connector will be dimensioned to fit snugly within the miter stabilizer slot.

Putting It Together

As indicated above, slat, jamb, and mounting band components are generally manufactured in lengths, for instance of 8 or 16 feet, and are cut into segments for use in making gable louver units. The first step in using the components is to consider a shape of an unfinished vent hole. The gable louver system of the present invention can be adapted to virtually any shape hole.

One will cut a jamb 20 into jamb segments 20' of appropriate lengths, and then miter cut both ends of each jamb segment at an angle determined by a shape of the gable louver to be constructed. Two complementary jamb segments 20' are joined together as shown in FIG. 6, while being held in a V-shape by a jig. They are welded together, with a plastic mending plate for instance by sonic welding at the mitered joint 44. Slat segments of graduated lengths are cut. While the jamb segments 20' are held in the jig, the shortest slat segment is fitted therein near the joint. Longer slat segments are placed in the jamb V until the V-shaped jamb is filled with slats, forming the louver jamb subassembly 40 of FIG. 6. The slats are held in place in the louver jamb subassembly by sonic welds 77 (FIG. 5) at edges of the slats with the jamb arms 22, 22'. The louver jamb subassembly may optionally be reinforced, such as by further attaching each slat to the jamb with aluminum pop rivets 79. Alternatively, the slats could be glued, nailed, stapled or otherwise fixed in place. In one embodiment, the slats are placed in the jamb segments and sonic welded at one edge to form sonic welds 77. This holds the slats in place so that the pop rivets 79 can be applied at the opposite edge. The pop rivets ensure that the louver jamb subassembly has adequate strength.

One will cut a mounting band length into segments corresponding to the sides of the gable louver assembly to be constructed, with both ends of each mounting-band segment being at an angle determined by the desired gable louver assembly shape. Next at least two complementary mounting-band segments are joined together in a V-shape, with a miter stabilizer inserted into and linking their two complementary miter stabilizer slots. The miter joint of the mounting band subassembly is reinforced by sonic welding and/or a plastic mending plate 81 (FIG. 9) across the joint, for instance welded on the backing 51 inside the jamb slot 25. The jamb slot 25 is wide enough to receive the jamb subassembly 40 and the plastic mending plate 81.

Finally, the louver jamb subassembly 40 is inserted into the thusly assembled at least two mounting-band segments and an outer perimeter thereof is closed by at least one additional complementary mounting-band segment, forming a gable louver assembly. The gable louver assembly is then reinforced by attaching the louver jamb subassembly to the mounting band with aluminium pop rivets through jamb wrap connector 52. This provides a completed gable louver assembly which can now be easily installed over an unfinished vent hole by nailing its mounting base 75 to an exterior of a wall forming the vent hole. The gable louver assembly then receives siding in the siding slot 60.

Benefits

A gable louver assembly in accordance with the present invention is structurally sound and attractive in appearance. It is designed to abate water penetration problems and to permit easy escape of water that may get into the mounting band (especially the bottom segment thereof). Water penetration abatement features include the backing 51 being wider than the decorative flange 53, the miter stabilizer slot drain opening 56, the weep holes 58, and the weep holes 59, all of which help water escape when a mounting-band segment is used to form a horizontal base of a louver assembly. Yet another water abatement feature is the inclusion of the raised edges 11 on the slats 10, which tend to block water blown upwardly along the slats by wind.

The slat, jamb, and mounting band components described herein permit relatively easy construction of a wide variety of differently shaped gable louver assemblies from just three components.

It is also beneficial that the louver assembly of this invention has an integral louver jamb subassembly that is constructed separately from the band segments 15', because in this manner the band segments can have features most beneficial for mounting the assembly on a wall and for water abatement. Also, the features of the jamb subassembly can be mainly focused on securely holding the slats.

Variations

The present invention has been illustrated with reference to a gable louver assembly having an isosceles triangular configuration. However, those skilled in the art will recognize, first, that the louver assemblies need not necessarily be used in gable areas, although they are ideal for that application, and, second, that many other variations in the overall shape of louver assemblies may be made in accordance with principles of the present invention, including other types of triangles, rectangles, octagons, and any other shapes dictated by aesthetics or function and containing mitered joints. FIGS. 11*a*, 11*b*, 11*c*, 11*d*, 11*e*, and 11*f* illustrate, without limiting, various configurations of louver assemblies that can be made with the present system.

Likewise, with respect to shape of the slats and mounting bands, while various preferred embodiments are herein described, it will be understood that modifications, alternatives, and equivalents are to be included within the scope of the invention. For instance, slats 10 may have other cross-sectional shapes, and/or may omit raised edges 11. Walls 19 and/or 29 and/or mounting band 15 may be made of other materials such as polyethylene, polypropylene, polystyrene, and acrylonitrile butadiene styrene, or even, for some applications, of wood or aluminum.

Finally, other features may be added to the louver assemblies of the invention. For instance, a screen of fiberglass or aluminum may be affixed to the back (inside) of the louver assemblies to inhibit penetration by insects. In fact, in one embodiment such a screen is mounted on the louver jamb subassembly 40 before it is positioned in the mounting-band segments.

Thus, inasmuch as the present invention is subject to many modifications, variations, and changes in detail, it is intended that all matter contained in the foregoing description or shown in the accompanying drawings shall be interpreted as illustrative and not in a limiting sense.

What is claimed is:

1. A flat-mount louver assembly comprising a louver mounting band and a plurality of slats having two ends, said slats being mounted in a louver jamb subassembly separate from said louver mounting band, wherein said louver jamb subassembly comprises first and second C-shaped channels, each having backs and open faces, said channels being joined together at a mitered joint with their open faces facing one another, said first channel holding one end of each of said slats and said second channel holding the other end of each of said slats, and wherein the back of a C-shaped channel of said louver jamb subassembly is mounted in a jamb slot of said louver mounting band, said louver mounting band comprising first and second segments, each segment having a planar mounting base, a planar connecting member perpendicular to said base defining a first side and a second side and having a connecting-member edge spaced apart from said base, and a planar flange substantially perpendicular to the first side of said connecting member edge, said flange and connecting member with a portion of said base defining said jamb slot.

2. The louver assembly of claim 1, having at least one mitered joint connecting said first and second segments of said louver mounting band.

3. The louver assembly of claim 2, wherein said mitered joint is reinforced by a miter stabilizer connector located within said louver mounting band.

4. The louver assembly of claim 1, wherein at least one slat of said plurality of slats comprises a raised edge configured to resist the flow of water.

5. The louver assembly of claim 1, wherein said base is wider than said flange so as to inhibit penetration of water into a building on which said louver assembly is mounted.

6. The louver assembly of claim 1, wherein a miter stabilizer slot is formed opposite said jamb slot.

7. The louver assembly of claim 6, wherein said miter stabilizer slot is provided with a drain opening along its length.

8. A method of making a louver assembly according to claim 1 that comprises the steps:

determining a frame shape for a louver assembly to be constructed, preparing two jamb segments to form a part of said frame shape, joining said two jamb segments together in a V-shape, preparing an array of slat segments of graduated lengths calculated to fill said V-shape, filling the V-shaped jamb with said slat segments to form a louver jamb subassembly, preparing at least two mounting-band segments to form a part of said frame shape, joining said at least two mounting-band segments together in a V-shape to form a mounting band subassembly, and inserting said louver jamb subassembly into said mounting band subassembly to form said louver assembly.

9. The method of claim 8, further comprising the step of joining at least one further mounting-band segment to the at least two mounting-band segments for completely surrounding the louver jamb subassembly.

* * * * *